US011028574B2

(12) United States Patent
Guo et al.

(10) Patent No.: US 11,028,574 B2
(45) Date of Patent: Jun. 8, 2021

(54) STEEL-PLATE-ENCASED PRECAST CONCRETE COLUMN FOOT JOINT AND CONSTRUCTION METHOD THEREFOR

(71) Applicant: CHINA STATE CONSTRUCTION ENGINEERING CORPORATION LIMITED, Beijing (CN)

(72) Inventors: Haishan Guo, Beijing (CN); Liming Li, Beijing (CN); Hu Qi, Beijing (CN); Xin Fan, Beijing (CN); Dongyan Wang, Beijing (CN); Jiao Geng, Beijing (CN); Lida Tian, Beijing (CN); Kang Liu, Beijing (CN); Ming Li, Beijing (CN); Tong Li, Beijing (CN); Yonglan Xie, Beijing (CN)

( * ) Notice: Subject to any disclaimer, the term of this patent is extended or adjusted under 35 U.S.C. 154(b) by 8 days.

(21) Appl. No.: 16/699,837

(22) Filed: Dec. 2, 2019

(65) Prior Publication Data

US 2020/0109550 A1 Apr. 9, 2020

Related U.S. Application Data

(63) Continuation of application No. PCT/CN2018/079983, filed on Mar. 22, 2018.

(30) Foreign Application Priority Data

Jun. 2, 2017 (CN) ..... 201710407167.3

(51) Int. Cl.
*E04B 1/21* (2006.01)
*E04C 3/34* (2006.01)
*E04H 9/02* (2006.01)

(52) U.S. Cl.
CPC ..... *E04B 1/21* (2013.01); *E04C 3/34* (2013.01); *E04H 9/025* (2013.01)

(58) Field of Classification Search
USPC ..... 52/292, 294, 296, 741.14, 741.15
See application file for complete search history.

(56) References Cited

U.S. PATENT DOCUMENTS 6,672,023 B2 * 1/2004 Henderson ..... F03D 13/22 52/296
2011/0126484 A1 * 6/2011 Carrion ..... E04B 1/24 52/426

(Continued)

FOREIGN PATENT DOCUMENTS

CN 103669598 A 3/2014
CN 101230598 A 11/2015

(Continued)

OTHER PUBLICATIONS

Internatinal Search Report of PCT/CN2018/079983, dated Jun. 12, 2018.

*Primary Examiner* — Joshua K Ihezie
(74) *Attorney, Agent, or Firm* — W&K IP

(57) ABSTRACT

The column-base joint includes a prefabricated-reinforced-concrete column and a reinforced-concrete foundation, and further includes a coating-steel-plate sleeve that is integrally prefabricated with the concrete column and encloses an exterior of a column base. A gap is between a bottom end of the coating-steel-plate sleeve and an upper surface of the foundation. An outside of the gap is provided with a plugging material. The joint further includes an annular rib plate all of whose edges are horizontally and seamlessly connected to an inner wall of the coating-steel-plate sleeve and whose middle portion is provided with a rib-plate opening. The annular rib plate is provided with a sleeve opening that matches with the grouting sleeve device.

10 Claims, 8 Drawing Sheets

(56) References Cited

U.S. PATENT DOCUMENTS

| | | | | |
|---|---|---|---|---|
| 2020/0102751 | A1* | 4/2020 | Guo | E04C 5/165 |
| 2020/0109550 | A1* | 4/2020 | Guo | E04B 1/21 |

FOREIGN PATENT DOCUMENTS

| | | | |
|---|---|---|---|
| CN | 105064389 | A | 11/2015 |
| CN | 207176717 | U | 4/2018 |
| JP | 2006233445 | A | 9/2006 |

* cited by examiner

STEEL-PLATE-ENCASED PRECAST CONCRETE COLUMN FOOT JOINT AND CONSTRUCTION METHOD THEREFOR

CROSS-REFERENCE TO RELATED APPLICATIONS

This application is a continuation of International Patent Application No. PCT/CN2018/079983 with a filing date of Mar. 22, 2018, designating the United States, now pending, and further claims priority to Chinese Patent Application No. 201710407167.3 with a filing date of Jun. 2, 2017. The content of the aforementioned applications, including any intervening amendments thereto, are incorporated herein by reference.

TECHNICAL FIELD

The present disclosure relates to the field of assembled concrete-structure constructions, and particularly relates to a steel-plate-coated assembled concrete column-base joint and constructing method thereof.

BACKGROUND

By the action of earthquakes that rarely happen, the positions of the column-base joints of concrete frame structures easily yield and form plastic hinge, and especially when the angle of rotation is large, frequently the base concrete peels off or is pressed to crisp due to insufficient constriction by the column stirrup. Such a damaged form of the column-base joints does not only increase the difficulty in the post-earthquake repairing, but also greatly improves the cost of the repairing.

Although the sleeve-grout-connected column-base joints that are commonly used in assembled concrete constructions have the mechanical properties the same as those of the site pouring structures, they also have the problem of being difficult to repair after earthquakes. Additionally, in the process of producing the prefabricated concrete columns, it is usually required to design a dedicated tooling to accurately fix the grouting sleeve, which has a high additional production cost.

SUMMARY

An object of the present disclosure is to provide a steel-plate-coated assembled concrete column-base joint and constructing method thereof, in order to solve the technical problems of the conventional assembled concrete column-base joints that the base stirrup constricts insufficiently, that the post-earthquake repairing has a high cost and that accurate fixing is difficult in the production of the grouting sleeve.

In order to realize the above object, the present disclosure employs the following technical solutions:

A steel-plate-coated assembled concrete column-base joint, comprising a prefabricated-reinforced-concrete column at an upper portion and a reinforced-concrete foundation at a lower portion that are vertically correspondingly spliced, the prefabricated-reinforced-concrete column being pre-buried with an internal-to-column longitudinal bar, an internal-to-column stirrup and a grouting sleeve device that are circumferentially evenly distributed along a column body, the reinforced-concrete foundation being pre-buried with a foundation anchoring-insertion steel bar, the foundation anchoring-insertion steel bar being connected to the internal-to-column longitudinal bar via a grout-injection material filling the grouting sleeve device, and a splicing seam between the reinforced-concrete foundation and the prefabricated-reinforced-concrete column being filled with the grout-injection material.

wherein the joint further comprises a coating-steel-plate sleeve that is integrally prefabricated with the concrete column and encloses an exterior of a column base, a top end of the coating-steel-plate sleeve is below a grout-injection hole and a grout exiting hole of the grouting sleeve device, a gap is between a bottom end of the coating-steel-plate sleeve and an upper surface of the foundation, and an outside of the gap is provided with a plugging material, and the joint further comprises an annular rib plate all of whose edges are horizontally and seamlessly connected to an inner wall of the coating-steel-plate sleeve and whose middle portion is provided with a rib-plate opening, the annular rib plate is located at a bottom of the coating-steel-plate sleeve and is above the bottom end of the coating-steel-plate sleeve to leave a steel-plate-cylinder rim, the steel-plate-cylinder rim, the annular rib plate, the plugging material and the upper surface of the foundation form a closed splicing-seam cavity, the annular rib plate is provided with a sleeve opening that matches with the grouting sleeve device, the grouting sleeve device sequentially passes through the sleeve opening and protrudes into the splicing-seam cavity, a bottom side face of the grouting sleeve device flushes with a bottom side face of the coating-steel-plate sleeve, and the splicing-seam cavity is filled with the grout-injection material.

Optionally, the coating-steel-plate sleeve has a height 1-3 times of a length of a long side of a cross section of the column, and a thickness of 1.0-30 mm, and is made of Q235B or Q345B steel.

Optionally, an outer side surface of the coating-steel-plate sleeve flushes with or protrudes from an outer side surface of the prefabricated-reinforced-concrete column.

Optionally, the internal-to-column stirrup is provided with a densified region from a column bottom end to a position that is above an upper end of the coating-steel-plate sleeve and is 0.5-1 time of a length of a long side of a cross section of the column.

Optionally, the rib-plate opening of the prefabricated-reinforced-concrete column is prefabricated with a coarse-surface layer flushing with the annular rib plate, or the bottom of the prefabricated-reinforced-concrete column is integrally prefabricated with a shear key body, the shear key body is enclosed by the grouting sleeve device and flushes with the bottom end of the coating-steel-plate sleeve, and a middle portion of the shear key body is of a concave funnel shape.

Optionally, the grouting sleeve device is a first sleeve that is provided with a non-independent grout-injection hole and an independent grout exiting hole, wherein the grout-injection materials within the first sleeve and the splicing-scam cavity are integrally poured, or a second sleeve that is provided with an independent grout-injection hole and an independent grout exiting hole, wherein the grout-injection materials within the second sleeve and the splicing-seam cavity are separately poured, and the independent grout-injection hole and the independent grout exiting hole are in communication with the sleeve via a corresponding grout-injection pipe buried within the column.

Optionally, the non-independent grout-injection hole is located at a column side wall, the non-independent grout-injection hole and the splicing-seam cavity are in communication via an internal-to-column grout flowing pipeline, the internal-to-column grout flowing pipeline is located inside the prefabricated-reinforced-concrete column, with one end in communication with the independent grout-injection hole, and the other end passing through the annular rib plate and in communication with the splicing-seam cavity, the splicing-seam cavity forms an external-to-column grout flowing pipeline of the grouting sleeve device, and a movement trajectory of the grout-injection material of the first sleeve is from the non-independent grout-injection hole, the internal-to-column grout flowing pipeline and the external-to-column grout flowing pipeline to the sleeves and flows out of the independent grout exiting hole.

Optionally, the internal-to-column grout flowing pipeline is a metal bellows buried within the column or a pipeline integrally prefabricated with the column, the internal-to-column grout flowing pipeline is of a reverse L shape, and comprises a horizontal pipeline and a vertical pipeline, the horizontal pipeline is in communication with an exterior of the side wall and has an inclination angle relative to the side wall, and the vertical pipeline is in communication with the splicing-seam cavity.

Optionally, a middle portion of the coarse-surface layer and a middle portion of the shear key body are provided with a grout-injection hole opening of the internal-to-column grout flowing pipeline.

A method for constructing the steel-plate-coated assembled concrete column-base joint, wherein steps of the constructing are as follows:

Step 1: in a plant fixedly connecting the internal-to-column longitudinal bar, the internal-to-column stirrup and the grouting sleeve device and binding into a steel reinforcement cage;

Step 2: in a plant welding four steel plates into the rectangular coating-steel-plate sleeve, opening the sleeve opening corresponding to the grouting sleeve device at the annular rib plate, and then fixing by welding the annular rib plate to the inner wall of the coating-steel-plate sleeve by fillet weld;

Step 3: inserting the steel reinforcement cage manufactured in the Step 1 into the coating-steel-plate sleeve manufactured in the Step 2, and after the grouting sleeve device has been accurately inserted into the sleeve opening to be integral, placing together into a column-body template;

Step 4: pouring concrete into the column-body template, at which time point plant manufacturing of the prefabricated-reinforced-concrete column is completed, and transporting the prefabricated-reinforced-concrete column to a construction site;

Step 5: after constructing of the foundation has been completed, inserting the foundation anchoring-insertion steel bar into the grouting sleeve device in the prefabricated-reinforced-concrete column, temporarily fixing, sealing the splicing-seam cavity by using the plugging material, and fixing the prefabricated-reinforced-concrete column by using a temporary support;

Step 6: preparing the grout-injection material, injecting the grout-injection material from the grout-injection hole, the grout-injection material flowing out of the grout exiting hole, and depending on the form of the sleeve, the grout-injection material integrally or separately filling the splicing-seam cavity and the sleeve, at which time point the grout injection ends; and Step 7: after the grout-injection material has coagulated to a certain strength, dismantling the temporary support of the prefabricated-reinforced-concrete column, to complete the constructing of the column-base joint.

As compared with the prior art, the present disclosure has the following characteristics and advantageous effects:

The present disclosure discloses a column-base joint of the field of assembled concrete-structure constructions. The column-base joint is provided with the added coating-steel-plate sleeve within a certain height range to reinforce the constriction to the column-bottom concrete. The synergistic action between the coating-steel-plate sleeve and the densifying stirrup at the column bottom better constricts the column-bottom concrete, which alleviates the damage on the column base in case of a large angle of rotation, and improves the ductility of the column-base joint.

Additionally, the adding of the annular rib plate within the coating-steel-plate sleeve can increase the constriction by the coating-steel-plate sleeve. Further, the annular rib plate is provided with the opening for fixing the steel-bar sleeve during pouring, which eliminates the fixing tooling of the sleeve in the component producting process, improves the positioning accuracy of the sleeve of the prefabricated column, and has a simple structure and a convenient constructing.

In addition, the grouting sleeve device of the present disclosure can employ the form not having an independent grout-injection hole, and can also employ the form having an independent grout-injection hole, which are, according to the different designed forms, individually formed at the annular rib plate, the coating-steel-plate sleeve and the top face of the foundation. The adding of the annular rib plate enables the splicing-seam cavity to be formed at the bottom of the column base, and in turn grout-injection connecting can be performed within the splicing-seam cavity, which can have a thickness larger than that of the splicing-seam connecting of the prior art. Moreover, the rough surface or the shear key body can be provided at the bottom face of the prefabricated column, which further enhances the shearing resistance of the column-base joint.

BRIEF DESCRIPTION OF THE DRAWINGS

The present disclosure will be described below in further details by referring to the drawings.

Reference numbers: 1—reinforced-concrete foundation, 2—prefabricated-reinforced-concrete column, 3—plugging material, 4—internal-to-column longitudinal bar, 5—internal-to-column stirrup, 6—grouting sleeve device, 61—non-independent grout-injection hole, 62—independent grout-injection hole, 63—independent grout exiting hole, 7—coating-steel-plate sleeve, 8—annular rib plate, 81—rib-plate opening, 82—sleeve opening, 9—internal-to-column grout flowing pipeline, 91—horizontal pipeline, 92—vertical pipeline, 10—coarse-surface layer, 11—shear key body, 12—foundation anchoring-insertion steel bar, 13—grout-injection material, and 14—grout-injection hole opening.

DETAILED DESCRIPTION

Figure 1:
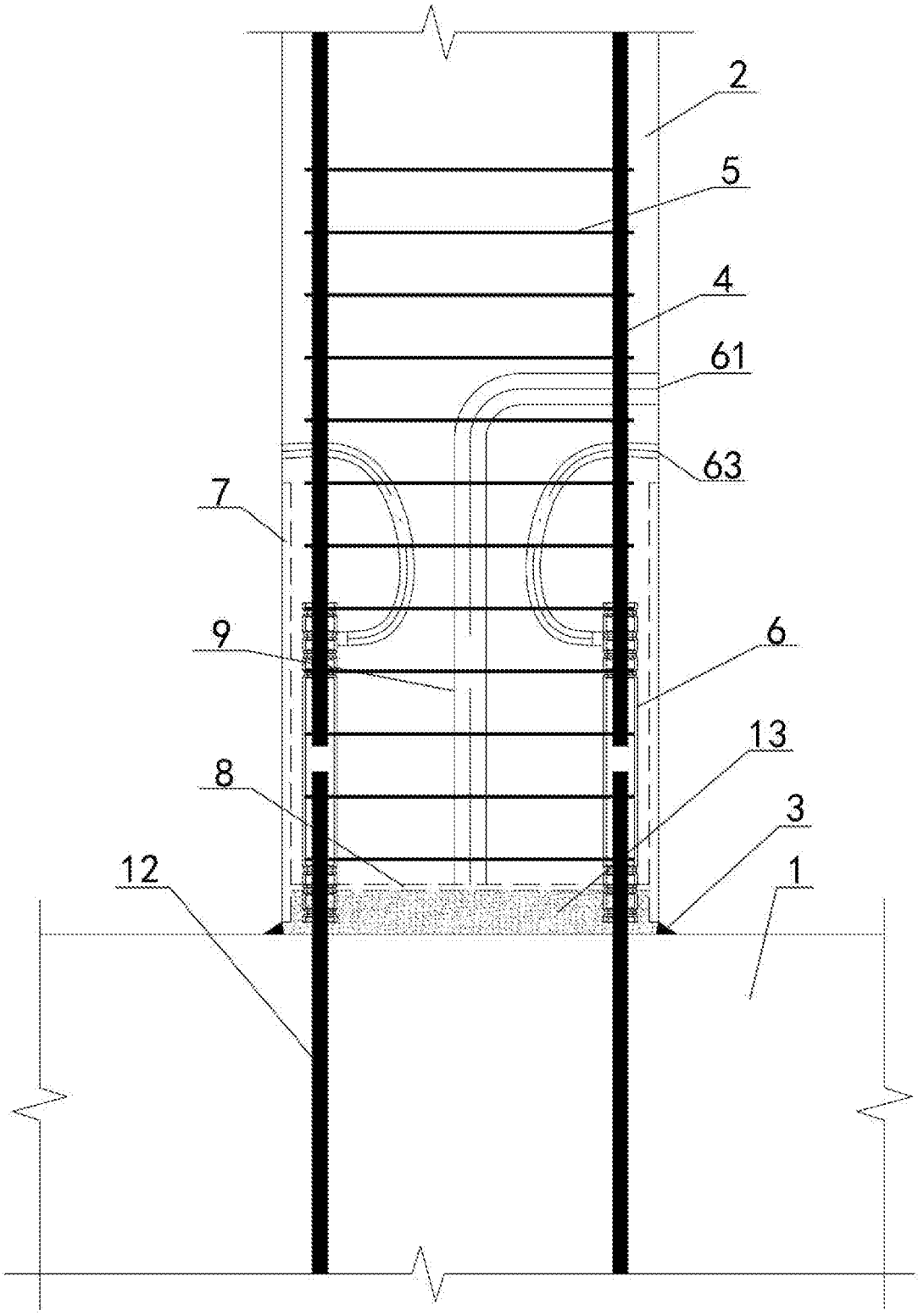
FIG. 1 is a schematic diagram of the first embodiment of the present disclosure.
Figure 2:
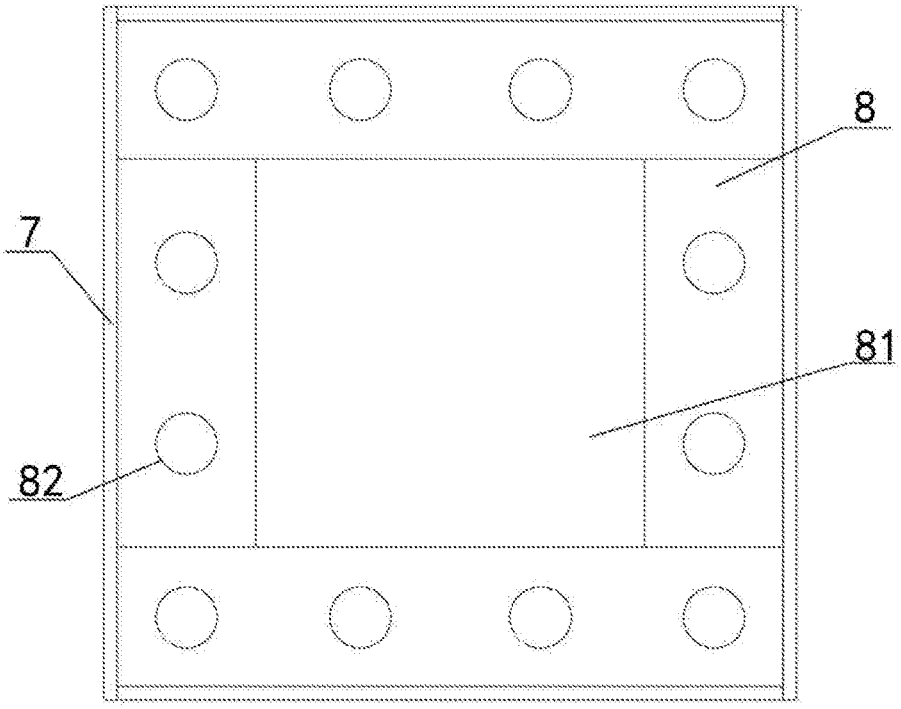
FIG. 2 is a schematic structural diagram of the annular rib plate.
Figure 3:
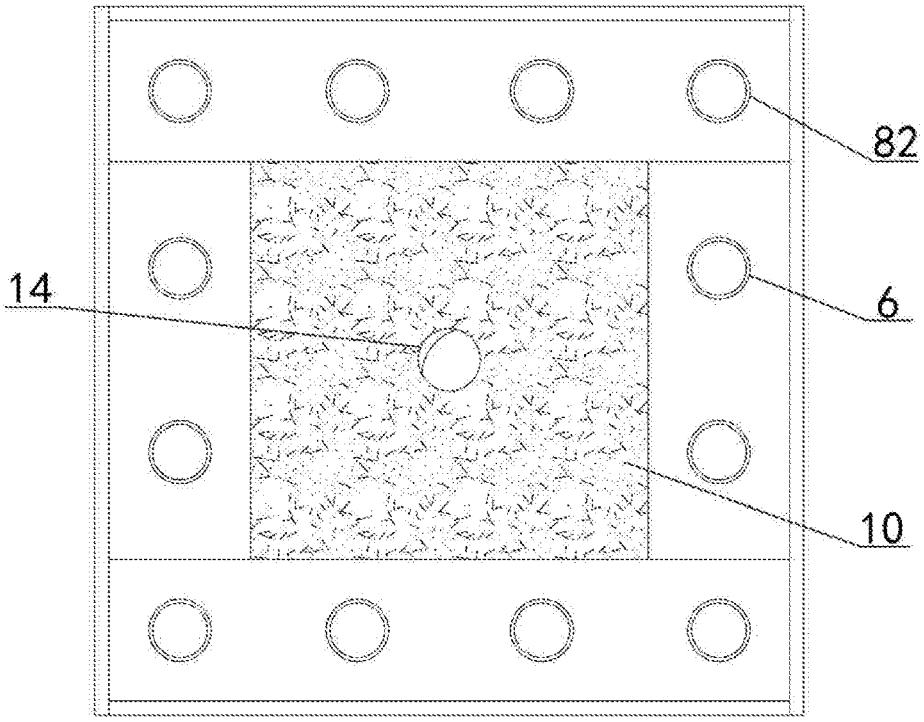
FIG. 3 is a view of the column bottom of the first embodiment of the present disclosure.

The first embodiment is shown in FIGS. 1-3. A steel-plate-coated assembled concrete column-base joint comprises a prefabricated-reinforced-concrete column 2 at the upper portion and a reinforced-concrete foundation 1 at the lower portion that are vertically correspondingly spliced. The prefabricated-reinforced-concrete column 2 is pre-buried with an internal-to-column longitudinal bar 4, an internal-to-column stirrup 5 and a grouting sleeve device 6 that are circumferentially evenly distributed along the column body. The reinforced-concrete foundation 1 is pre-buried with a foundation anchoring-insertion steel bar 12. The foundation anchoring-insertion steel bar 12 is connected to the internal-to-column longitudinal bar 4 via a grout-injection material 13 filling the grouting sleeve device 6. A splicing seam between the reinforced-concrete foundation 1 and the prefabricated-reinforced-concrete column 2 is filled with the grout-injection material 13.

The joint further comprises a coating-steel-plate sleeve 7 that is integrally prefabricated with the concrete column and encloses the exterior of the column base. The top end of the coating-steel-plate sleeve 7 is below a grout-injection hole and a grout exiting hole of the grouting sleeve device. A gap is between the bottom end of the coating-steel-plate sleeve 7 and the upper surface of the foundation. In the installation process, as a measure for eliminating the set-up error, the width of the gap is 20-30 mm. The outside of the gap is provided with a plugging material 3.

The joint further comprises an annular rib plate 8 all of whose edges are horizontally and seamlessly connected to an inner wall of the coating-steel-plate sleeve 7 and whose middle portion is provided with a rib-plate opening 81. The annular rib plate 8 is located at the bottom of the coating-steel-plate sleeve and is above the bottom end of the coating-steel-plate sleeve 7 to leave a steel-plate-cylinder rim. The steel-plate-cylinder rim, the annular rib plate 8, the plugging material 3 and the upper surface of the foundation form a closed splicing-seam cavity. The annular rib plate is provided with a sleeve opening 82 that matches with the grouting sleeve device 6. The grouting sleeve device 6 sequentially passes through the sleeve opening 82 and protrudes into the splicing-seam cavity. The bottom side face of the grouting sleeve device 6 flushes with the bottom side face of the coating-steel-plate sleeve 7. The splicing-seam cavity is filled with the grout-injection material 13. The grout-injection material 13 is a non-contracting high-strength grouting material, and may employ a high-strength quick-hardening-cement-based grouting material, a steel-fiber quick-hardening-cement-based grouting material, a carbon-fiber quick-hardening-cement-based grouting material or a polymer mortar material that have a compressive strength above 45 MPa.

The coating-steel-plate sleeve 7 has a height 1-3 times of the length of the long side of the cross section of the column, and a thickness of 1.0-30 mm, and is made of Q235B or Q345B steel. The outer side surface of the coating-steel-plate sleeve 7 flushes with or protrudes from the outer side surface of the prefabricated-reinforced-concrete column 2. In the present embodiment they flush. The internal-to-column stirrup 5 is provided with a densified region from the column bottom end to a position that is above the upper end of the coating-steel-plate sleeve 7 and is 0.5-1 time of the length of the long side of the cross section of the column.

As shown in FIG. 2, in the present embodiment, the coating-steel-plate sleeve 7 is rectangular, so the annular rib plate is also rectangular, and is provided with a rectangular rib-plate opening 81 at the middle portion. The sleeve openings 82 are circumferentially evenly distributed along the annular rib plate correspondingly to the sleeve. The diameter of the sleeve opening 82 is greater than that of the sleeve by 2-4 mm.

The grouting sleeve device 6 is a first sleeve that is provided with a non-independent grout-injection hole 61 and an independent grout exiting hole 63. The grout-injection materials 13 within the first sleeve and the splicing-seam cavity are integrally poured. The independent grout exiting hole 63 is in communication with the sleeve via a corresponding grout-injection pipe buried within the column.

The non-independent grout-injection hole 61 is located at the column side wall. The non-independent grout-injection hole 61 and the splicing-seam cavity are in communication via an internal-to-column grout flowing pipeline 9. The internal-to-column grout flowing pipeline is located inside the prefabricated-reinforced-concrete column 2, with one end in communication with the independent grout-injection hole 61, and the other end passing through the annular rib plate and in communication with the splicing-seam cavity. The splicing-seam cavity forms an external-to-column grout flowing pipeline of the grouting sleeve device 6. The movement trajectory of the grout-injection material 13 of the first sleeve is from the non-independent grout-injection hole 61, the internal-to-column grout flowing pipeline 9 and the external-to-column grout flowing pipeline to the sleeves and flows out of the independent grout exiting hole 63.

The internal-to-column grout flowing pipeline 9 is a metal bellows buried within the column. The internal-to-column grout flowing pipeline 9 is of a reverse L shape, and comprises a horizontal pipeline 91 and a vertical pipeline 92. The horizontal pipeline 91 is in communication with the exterior of the side wall and has an inclination angle relative to the side wall, to facilitate the grout to flow in. The vertical pipeline 92 is in communication with the splicing-seam cavity.

The rib-plate opening 81 of the prefabricated-reinforced-concrete column 2 is prefabricated with a coarse-surface layer 10 flushing with the annular rib plate 8. The convex-concave of the coarse-surface layer 10 is not less than 6 mm, and the middle portion is provided with a grout-injection hole opening 14 of the internal-to-column grout flowing pipeline.

Figure 4:
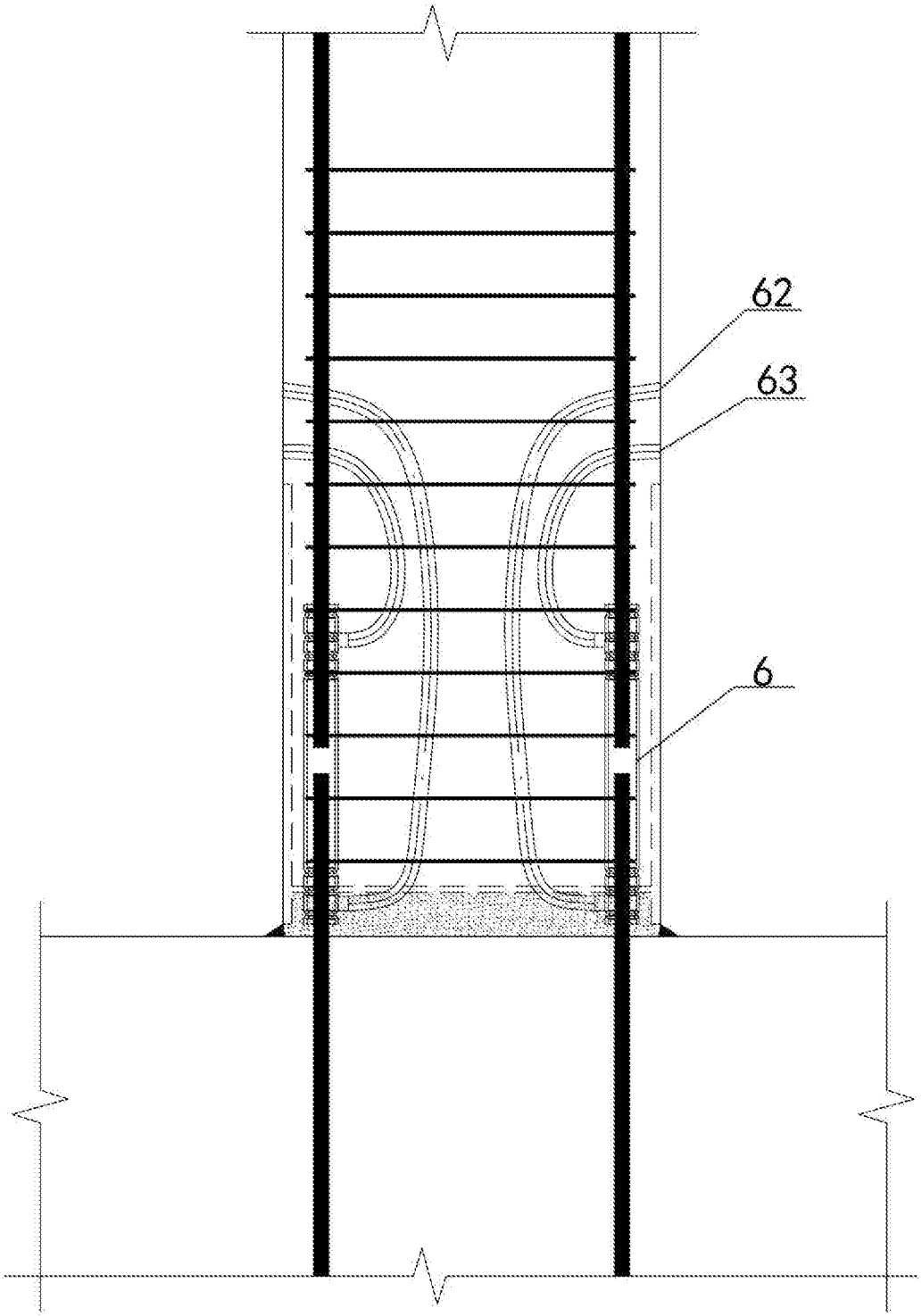
FIG. 4 is a schematic diagram of the second embodiment of the present disclosure.
Figure 5:
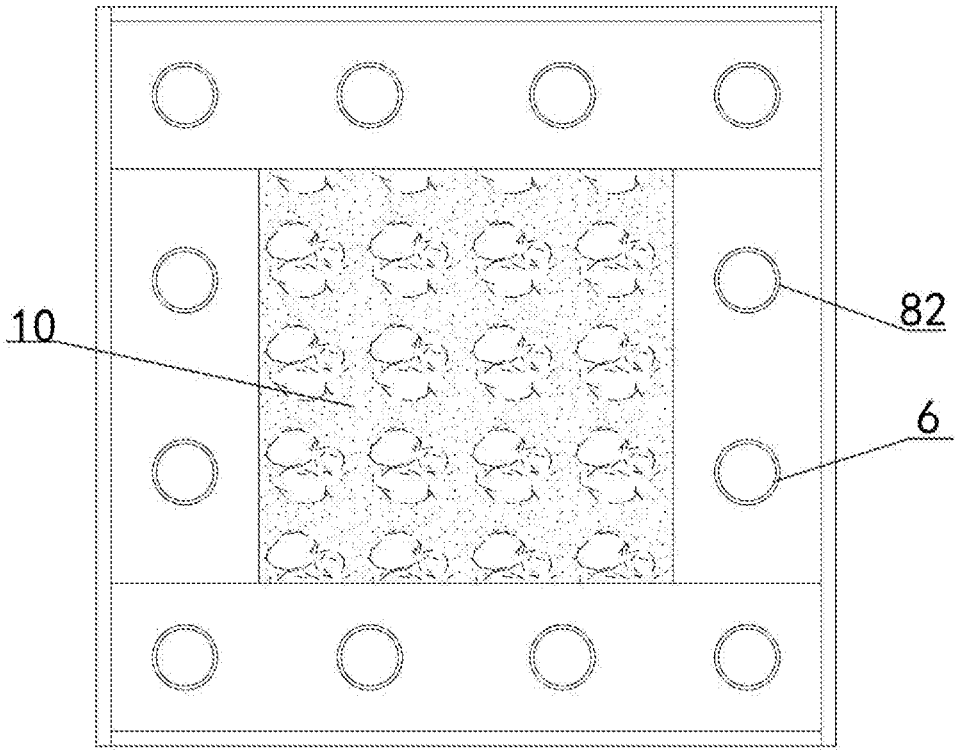
FIG. 5 is a view of the column bottom of the second embodiment of the present disclosure.

The second embodiment is shown in FIGS. 4-5, and differs from the first embodiment in that the grouting sleeve device 6 is a second sleeve that is provided with an independent grout-injection hole 62 and an independent grout exiting hole 63, the grout-injection materials 13 within the second sleeve and the splicing-seam cavity are separately poured, and the independent grout-injection hole 62 and the independent grout exiting hole 63 are in communication with the sleeve via a corresponding grout-injection pipe buried within the column.

Figure 6:
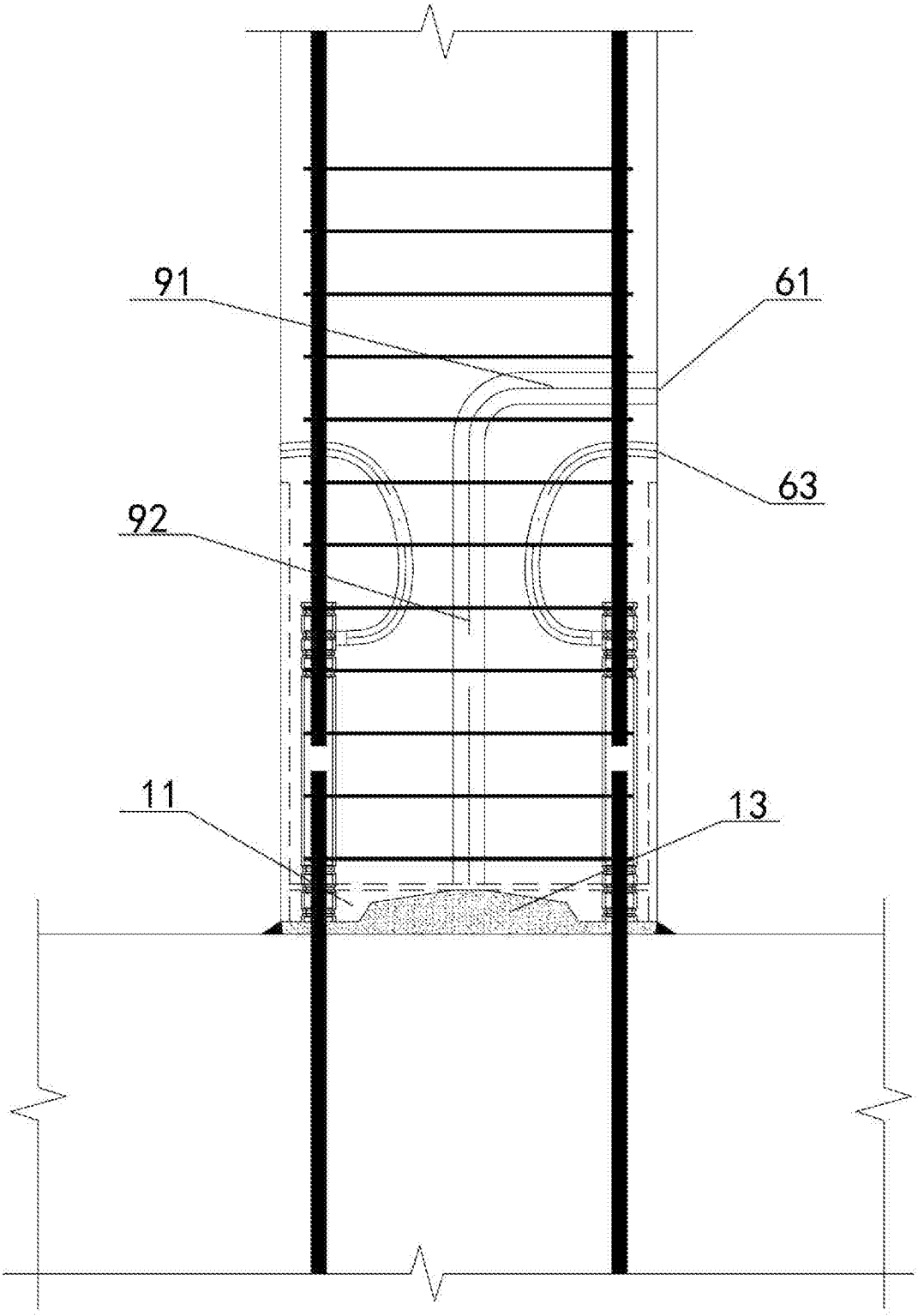
FIG. 6 is a schematic diagram of the third embodiment of the present disclosure.
Figure 7:
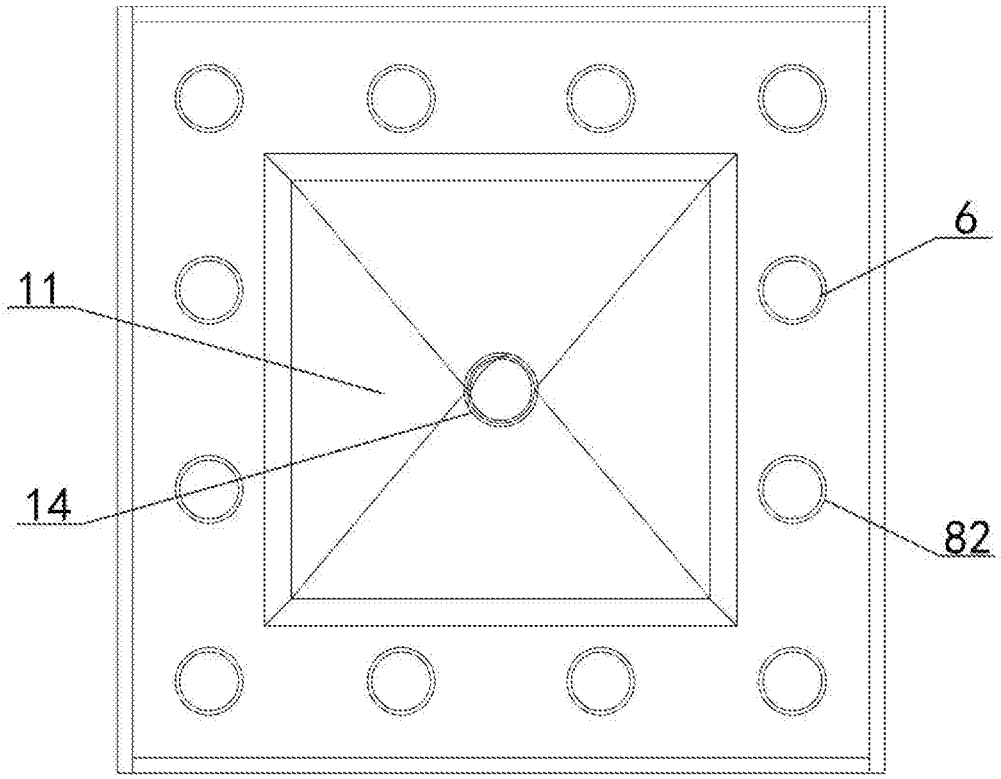
FIG. 7 is a view of the column bottom of the third embodiment of the present disclosure.

The third embodiment is shown in FIGS. 6-7, and differs from the first embodiment in that the internal-to-column grout flowing pipeline 9 is a pipeline integrally prefabricated with the column, the bottom of the prefabricated-reinforced-concrete column 2 is integrally prefabricated with a shear key body 11, the shear key body 11 is enclosed by the grouting sleeve device 6 and flushes with the bottom end of the coating-steel-plate sleeve 7, a middle portion of the shear key body 11 is of a concave funnel shape, the concave funnel shape and the top face of the foundation form a cavity, the cavity is filled with the grout-injection material 13, and a middle portion of the shear key body 11 is provided with a grout-injection hole opening 14 of the internal-to-column grout flowing pipeline.

Figure 8:
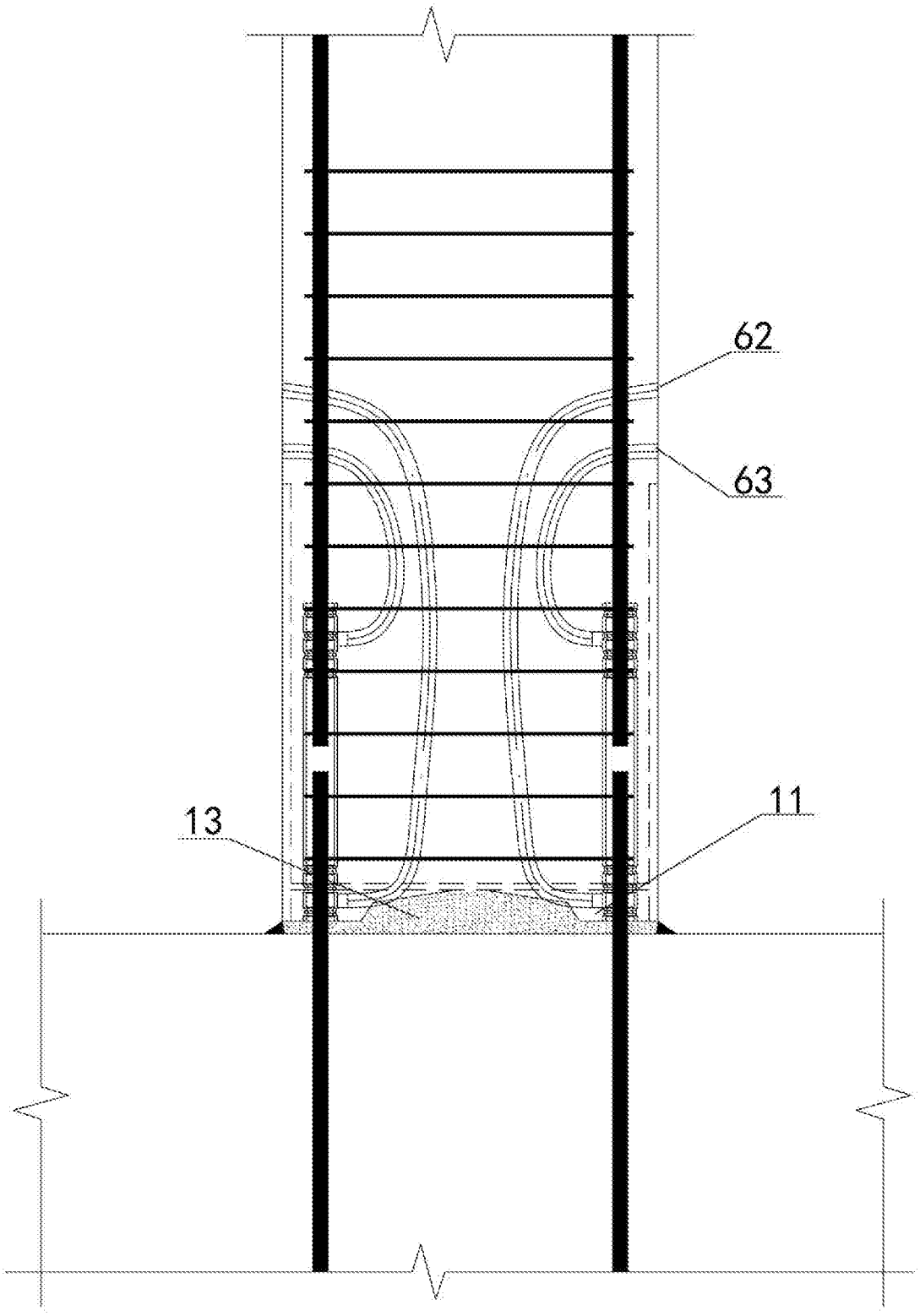
FIG. 8 is a schematic diagram of the fourth embodiment of the present disclosure.
Figure 9:
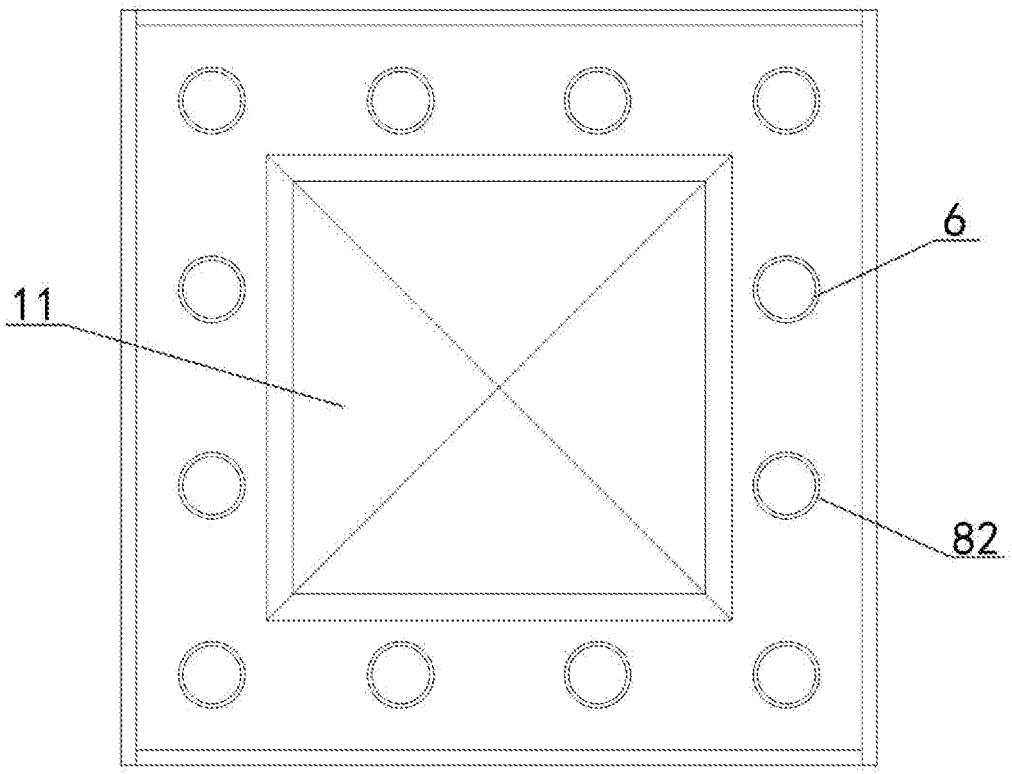
FIG. 9 is a view of the column bottom of the fourth embodiment of the present disclosure.

The fourth embodiment is shown in FIGS. 8-9, and differs from the second embodiment in that the bottom of the prefabricated-reinforced-concrete column 2 is integrally prefabricated with a shear key body 11, the shear key body 11 is enclosed by the grouting sleeve device 6 and flushes with the bottom end of the coating-steel-plate sleeve 7, a middle portion of the shear key body 11 is of a concave funnel shape, the concave funnel shape and the top face of the foundation form a cavity, the cavity is filled with the grout-injection material 13, and a middle portion of the shear key body 11 is provided with a grout-injection hole opening 14 of the internal-to-column grout flowing pipeline.

A method for constructing the steel-plate-coated assembled concrete column-base joint of the first embodiment and the third embodiment comprises the steps of the constructing as follows:

Step 1: fixedly connecting the internal-to-column longitudinal bar 4, the internal-to-column stirrup 5 and the grouting sleeve device 6 and binding into a steel reinforcement cage;

Step 2: in a plant welding four steel plates into the rectangular coating-steel-plate sleeve 7, opening the sleeve opening 82 corresponding to the grouting sleeve device 6 at the annular rib plate 8, and then fixing by welding the annular rib plate 8 to the inner wall of the coating-steel-plate sleeve 7 by fillet weld;

Step 3: inserting the steel reinforcement cage manufactured in the Step 1 into the coating-steel-plate sleeve 7 manufactured in the Step 2, and after the grouting sleeve device 6 has been accurately inserted into the sleeve opening 82 to be integral, placing together into a column-body template;

Step 4: pouring concrete into the column-body template, at which time point the plant manufacturing of the prefabricated-reinforced-concrete column 2 is completed, and transporting the prefabricated-reinforced-concrete column 2 to a construction site;

Step 5: after constructing of the foundation has been completed, inserting the foundation anchoring-insertion steel bar 12 into the grouting sleeve device 6 in the prefabricated-reinforced-concrete column 2, temporarily fixing, sealing the splicing-seam cavity by using the plugging material 3, and fixing the prefabricated-reinforced-concrete column 2 by using a temporary support;

Step 6: preparing the grout-injection material 13, injecting from the non-independent grout-injection hole 61, the grout-injection material 13 flowing through the internal-to-column grout flowing pipeline 9 to fill the external-to-column grout flowing pipeline, then the grout-injection material 13 flowing upwardly to fill all of the sleeves, flowing out of the independent grout exiting hole 63 after the sleeves are full of the grout, then closing the grout exiting holes one by one, and ending the grout injection when all of the grout exiting holes have been closed; and Step 7: after the grout-injection material 13 has coagulated to a certain strength, dismantling the temporary support of the prefabricated-reinforced-concrete column, to complete the constructing of the column-base joint.

A method for constructing the steel-plate-coated assembled concrete column-base joint of the second embodiment and the fourth embodiment comprises the steps of the constructing as follows:

Step 1: fixedly connecting the internal-to-column longitudinal bar 4, the internal-to-column stirrup 5 and the grouting sleeve device 6 and binding into a steel reinforcement cage;

Step 2: in a plant welding four steel plates into the rectangular coating-steel-plate sleeve 7, opening the sleeve opening 82 corresponding to the grouting sleeve device 6 at the annular rib plate 8, and then fixing by welding the annular rib plate 8 to the inner wall of the coating-steel-plate sleeve 7 by fillet weld;

Step 3: inserting the steel reinforcement cage manufactured in the Step 1 into the coating-steel-plate sleeve 7 manufactured in the Step 2, and after the grouting sleeve device 6 has been accurately inserted into the sleeve opening 82 to be integral, placing together into a column-body template;

Step 4: pouring concrete into the column-body template, at which time point the plant manufacturing of the prefabricated-reinforced-concrete column 2 is completed, and transporting the prefabricated-reinforced-concrete column 2 to a construction site;

Step 5: after constructing of the foundation has been completed, inserting the foundation anchoring-insertion steel bar 12 into the grouting sleeve device 6 in the prefabricated-reinforced-concrete column 2, temporarily fixing, sealing the splicing-seam cavity by using the plugging material 3, then filling the splicing-seam cavity with the grout-injection material 13, and fixing the prefabricated-reinforced-concrete column 2 by using a temporary support;

Step 6: preparing the grout-injection material 13, injecting from the independent grout-injection hole 62, the grout-injection material 13 flowing through the grout-injection pipe to fill all of the sleeves, flowing out of the independent grout exiting hole 63 after the sleeves are full of the grout, then closing the grout exiting holes one by one, and ending the grout injection when all of the grout exiting holes have been closed; and Step 7: after the grout-injection material 13 has coagulated to a certain strength, dismantling the temporary support of the prefabricated-reinforced-concrete column, to complete the constructing of the column-base joint.

We claim:

1. A steel-plate-coated assembled concrete column-base joint, comprising a prefabricated-reinforced-concrete column (2) at an upper portion and a reinforced-concrete foundation (1) at a lower portion that are vertically correspondingly spliced, the prefabricated-reinforced-concrete column (2) being pre-buried with an internal-to-column longitudinal bar (4), an internal-to-column stirrup (5) and a grouting sleeve device (6) that are circumferentially evenly distributed along a column body, the reinforced-concrete foundation (1) being pre-buried with a foundation anchoring-insertion steel bar (12), the foundation anchoring-insertion steel bar (12) being connected to the internal-to-column longitudinal bar (4) via a grout-injection material (13) filling the grouting sleeve device (6), and a splicing seam between the reinforced-concrete foundation (1) and the prefabricated-reinforced-concrete column (2) being filled with the grout-injection material (13), wherein the joint further comprises a coating-steel-plate sleeve (7) that is integrally prefabricated with the concrete column and encloses an exterior of a column base, a top end of the coating-steel-plate sleeve (7) is below a grout-injection hole and a grout exiting hole of the grouting sleeve device, a gap is between a bottom end of the coating-steel-plate sleeve (7) and an upper surface of the foundation, and an outside of the gap is provided with a plugging material (3), and the joint further comprises an annular rib plate (8) all of whose edges are horizontally and seamlessly connected to an inner wall of the coating-steel-plate sleeve (7) and whose middle portion is provided with a rib-plate opening (81), the annular rib plate (8) is located at a bottom of the coating-steel-plate sleeve and is above the bottom end of the coating-steel-plate sleeve (7) to leave a steel-plate-cylinder rim, the steel-plate-cylinder rim, the annular rib plate (8), the plugging material (3) and the upper surface of the foundation form a closed splicing-seam cavity, the annular rib plate is provided with a sleeve opening (82) that matches with the grouting sleeve device (6), the grouting sleeve device (6) sequentially passes through the sleeve opening (82) and protrudes into the splicing-seam cavity, a bottom side face of the grouting sleeve device (6) flushes with a bottom side face of the coating-steel-plate sleeve (7), and the splicing-seam cavity is filled with the grout-injection material (13).

2. The steel-plate-coated assembled concrete column-base joint according to claim 1, wherein the coating-steel-plate sleeve (7) has a height 1-3 times of a length of a long side of a cross section of the column, and a thickness of 1.0-30 mm, and is made of Q235B or Q345B steel.

3. The steel-plate-coated assembled concrete column-base joint according to claim 1, wherein an outer side surface of the coating-steel-plate sleeve (7) flushes with or protrudes from an outer side surface of the prefabricated-reinforced-concrete column (2).

4. The steel-plate-coated assembled concrete column-base joint according to claim 1, wherein the internal-to-column stirrup (5) is provided with a densified region from a column bottom end to a position that is above an upper end of the coating-steel-plate sleeve (7) and is 0.5-1 time of a length of a long side of a cross section of the column.

5. The steel-plate-coated assembled concrete column-base joint according to claim 1, wherein the rib-plate opening (81) of the prefabricated-reinforced-concrete column (2) is prefabricated with a coarse-surface layer (10) flushing with the annular rib plate (8), or the bottom of the prefabricated-reinforced-concrete column (2) is integrally prefabricated with a shear key body (11), the shear key body (11) is enclosed by the grouting sleeve device (6) and flushes with the bottom end of the coating-steel-plate sleeve (7), and a middle portion of the shear key body (11) is of a concave funnel shape.

6. The steel-plate-coated assembled concrete column-base joint according to claim 1, wherein the grouting sleeve device (6) is a first sleeve that is provided with a non-independent grout-injection hole (61) and an independent grout exiting hole (63), wherein the grout-injection materials (13) within the first sleeve and the splicing-seam cavity are integrally poured, or a second sleeve that is provided with an independent grout-injection hole (62) and an independent grout exiting hole (63), wherein the grout-injection materials (13) within the second sleeve and the splicing-seam cavity are separately poured, and the independent grout-injection hole (62) and the independent grout exiting hole (63) are in communication with the sleeve via a corresponding grout-injection pipe buried within the column.

7. The steel-plate-coated assembled concrete column-base joint according to claim 6, wherein the non-independent grout-injection hole (61) is located at a column side wall, the non-independent grout-injection hole (61) and the splicing-seam cavity are in communication via an internal-to-column grout flowing pipeline (9), the internal-to-column grout flowing pipeline is located inside the prefabricated-reinforced-concrete column (2), with one end in communication with the independent grout-injection hole (61), and the other end passing through the annular rib plate and in communication with the splicing-seam cavity, the splicing-seam cavity forms an external-to-column grout flowing pipeline of the grouting sleeve device (6), and a movement trajectory of the grout-injection material (13) of the first sleeve is from the non-independent grout-injection hole (61), the internal-to-column grout flowing pipeline (9) and the external-to-column grout flowing pipeline to the sleeves and flows out of the independent grout exiting hole (63).

8. The steel-plate-coated assembled concrete column-base joint according to claim 7, wherein the internal-to-column grout flowing pipeline (9) is a metal bellows buried within the column or a pipeline integrally prefabricated with the column, the internal-to-column grout flowing pipeline (9) is of a reverse L shape, and comprises a horizontal pipeline (91) and a vertical pipeline (92), the horizontal pipeline (91) is in communication with an exterior of the side wall and has an inclination angle relative to the side wall, and the vertical pipeline (92) is in communication with the splicing-seam cavity.

9. The steel-plate-coated assembled concrete column-base joint according to claim 7, wherein a middle portion of the coarse-surface layer (10) and a middle portion of the shear key body (11) are provided with a grout-injection hole opening (14) of the internal-to-column grout flowing pipeline.

10. A method for constructing the steel-plate-coated assembled concrete column-base joint according to claim 1, wherein steps of the constructing are as follows:

Step 1: in a plant fixedly connecting the internal-to-column longitudinal bar (4), the internal-to-column stirrup (5) and the grouting sleeve device (6) and binding into a steel reinforcement cage;

Step 2: in a plant welding four steel plates into the rectangular coating-steel-plate sleeve (7), opening the sleeve opening (82) corresponding to the grouting sleeve device (6) at the annular rib plate (8), and then fixing by welding the annular rib plate (8) to the inner wall of the coating-steel-plate sleeve (7) by fillet weld;

Step 3: inserting the steel reinforcement cage manufactured in the Step 1 into the coating-steel-plate sleeve (7) manufactured in the Step 2, and after the grouting sleeve device (6) has been accurately inserted into the sleeve opening (82) to be integral, placing together into a column-body template;

Step 4: pouring concrete into the column-body template, at which time point plant manufacturing of the prefabricated-reinforced-concrete column (2) is completed, and transporting the prefabricated-reinforced-concrete column (2) to a construction site;

Step 5: after constructing of the foundation has been completed, inserting the foundation anchoring-insertion steel bar (12) into the grouting sleeve device (6) in the prefabricated-reinforced-concrete column (2), temporarily fixing, sealing the splicing-seam cavity by using the plugging material (3), and fixing the prefabricated-reinforced-concrete column (2) by using a temporary support;

Step 6: preparing the grout-injection material (13), injecting the grout-injection material from the grout-injection hole, the grout-injection material flowing out of the grout exiting hole, and depending on the form of the sleeve, the grout-injection material integrally or separately filling the splicing-seam cavity and the sleeve, at which time point the grout injection ends; and Step 7: after the grout-injection material (13) has coagulated to a certain strength, dismantling the temporary support of the prefabricated-reinforced-concrete column, to complete the constructing of the column-base joint.

* * * * *